US011084630B2

(12) United States Patent
Sergienko

(10) Patent No.: US 11,084,630 B2
(45) Date of Patent: Aug. 10, 2021

(54) COMBINATION OF A BOTTLE AND CORK

(71) Applicant: FINIST GLOBAL TRADING SIA, Riga (LV)

(72) Inventor: Igor Nikolaevich Sergienko, g. Odintsovo (RU)

(73) Assignee: FINIST GLOBAL TRADING SIA, Riga (LV)

( * ) Notice: Subject to any disclaimer, the term of this patent is extended or adjusted under 35 U.S.C. 154(b) by 0 days.

(21) Appl. No.: 16/313,609

(22) PCT Filed: Jun. 30, 2017

(86) PCT No.: PCT/RU2017/000467
§ 371 (c)(1),
(2) Date: Dec. 27, 2018

(87) PCT Pub. No.: WO2018/004397
PCT Pub. Date: Jan. 4, 2018

(65) Prior Publication Data

US 2019/0225385 A1 Jul. 25, 2019

(30) Foreign Application Priority Data

Jul. 1, 2016 (RU) ..... RU2016126615

(51) Int. Cl.
*B65D 39/16* (2006.01)
*B65D 39/08* (2006.01)
*B65D 39/00* (2006.01)

(52) U.S. Cl.
CPC ..... *B65D 39/16* (2013.01); *B65D 39/00* (2013.01); *B65D 39/08* (2013.01)

(58) Field of Classification Search
CPC ..... B65D 39/16
USPC ..... 215/296, 228, 46, 356, 357; D9/544, D9/545, 443, 433
See application file for complete search history.

(56) References Cited

U.S. PATENT DOCUMENTS 29,563 A * 8/1860 Bodine ..... B65D 39/08 215/357
403,466 A * 5/1889 Glover ..... B65D 39/08 215/357
439,693 A * 11/1890 Sanger ..... B65D 39/08 215/357

(Continued)

OTHER PUBLICATIONS

"Novaia naturalnaia probka Helix ot Amorim izbavit nas ot shtoporov uzhe z 2015", http://winge-mag.ru./archives/430, Nov. 13, 2014, 5 pages.

*Primary Examiner* — J. Gregory Pickett
*Assistant Examiner* — Niki M Eloshway
(74) *Attorney, Agent, or Firm* — Oblon, McClelland, Maier & Neustadt, L.L.P.

(57) ABSTRACT

The present invention relates to devices for corking bottles, and more particularly to the corking of glass bottles having necks containing a cork with an upper portion which rises above a rim, and may be used for corking bottles. A device for corking bottles contains a neck with a rim, and a cork, an end portion of the rim having protrusions, providing the ability to raise the cork by rotating same by the upper portion thereof. The neck, rim and upper portion of the cork are rectangular and/or oval in horizontal cross-section. The neck and rim are, on the two wide sides thereof, made in the form of parallel flat common surfaces. The narrow sides of the rim are hook-shaped.

2 Claims, 2 Drawing Sheets

(56) References Cited

U.S. PATENT DOCUMENTS

| | | | | | |
|---|---|---|---|---|---|
| 481,363 | A * | 8/1892 | Macauley | B65D 39/08 | 215/357 |
| 509,525 | A * | 11/1893 | Gray | C03B 9/165 | 65/293 |
| 881,067 | A * | 3/1908 | Fleming | B65D 39/08 | 215/357 |
| 1,423,592 | A * | 7/1922 | Baldwin | B65D 39/08 | 215/357 |
| 2,026,304 | A * | 12/1935 | Deady | B65D 1/023 | 215/283 |
| 2,081,138 | A | 5/1937 | Andersen et al. | | |
| 2,549,404 | A | 4/1951 | Williams | | |
| D202,382 | S * | 9/1965 | Heisler et al. | D9/533 | |
| 5,662,233 | A | 9/1997 | Reid | | |
| 6,216,897 | B1 * | 4/2001 | Wagner | B65D 23/04 | 215/329 |
| 6,989,003 | B2 * | 1/2006 | Wing | A61B 17/34 | 604/161 |
| 7,063,221 | B2 * | 6/2006 | Garcia-Cuenca | B65D 1/023 | 215/307 |
| 7,374,357 | B2 * | 5/2008 | Takahashi | A61C 5/66 | 215/296 |
| 9,156,719 | B2 * | 10/2015 | Perrone | B65D 1/0246 | |
| 2004/0089628 | A1 * | 5/2004 | Fleischer | B65D 39/0005 | 215/355 |
| 2010/0264107 | A1 * | 10/2010 | Lonsway | B65D 1/023 | 215/40 |
| 2012/0000878 | A1 * | 1/2012 | Reisig | B65D 1/023 | 215/40 |
| 2014/0158659 | A1 * | 6/2014 | Paredes | B65D 1/023 | 215/43 |

* cited by examiner

COMBINATION OF A BOTTLE AND CORK

FIELD

The present invention relates to devices for corking bottles and, more particularly, corking bottles with necks and rims containing a cork with an upper portion which rises above the rim.

BACKGROUND

Bottle closure devices comprising a neck, a rim, and a cork configured as solids of rotation are commonly known.

Such devices are disadvantageous in that the cork is difficult to release.

Aids (a corkscrew) are required to release a natural cork, such aids damaging the cork integrity and, occasionally, destroying it.

Corks with an upper portion which is typically cylinder-shaped and having the same diameter as the rim also take some time to be released due to the cork sticking.

Gripping force that may be provided with round necks is insufficient to prevent the bottle slipping and to easily remove the cork.

Known are corks having a superstructure configured as a rod with a T-shaped handle above their upper portion.

Such designs are disadvantageous in that they require the packaging height to be increased, and that they present difficulties in placing them in standard shipping boxes and refrigerators.

The analogous solution (prototype) closest to the claimed design is Helix, a cork stopper developed by the two world leaders—Amorim (the cork) and O-I (the glassware, ref. to web-site vinographia.ru. Site search: Natural'naya probka Helix). The Helix ("spiral") twist system comprises a glass bottle with a rim, both of circular cross-section, the rim inner surface having inwardly protruding thread members acting as guides, and a cork stopper with a lower portion also having thread grooves, the upper portion of the cork stopper projecting above the rim and having the same diameter as the rim.

The cork stopper may be released from the neck just by twisting without the need for a corkscrew. The cork stopper may also be twisted back in place.

The disadvantages of such design are the complexity and high cost of the "rim/cork stopper" pair manufacture and the likelihood of the cork stopper upper portion tearing off when twisting it out.

Another disadvantage is that the cork stopper cannot be twisted out by left-handed persons, and that the cork stopper cannot be released by bidirectional rotation with rocking.

To the best of knowledge, this design has not yet been put into practice due to the above reasons.

In contrast to natural cork stoppers allowing wine to breath, stoppers for hard liquor bottles are made from other materials to prevent contact with aerial oxygen via diffusion and liquor oxidation; more tight closure is used to achieve this.

During prolonged storage of hard liquors, stopper sticking also occurs, requiring considerable force to release the stopper.

SUMMARY OF THE INVENTION

It is an object of the claimed invention to provide a device for corking bottles, preferably the bottles containing liquors, to improve corking tightness, to facilitate bottle opening and closing, to improve strength and consumer performance, and to provide for the capability of being opened and closed by both right- and left-handed persons.

The above object is achieved by providing a device characterized by a combination of essential features sufficient to solve the above technical problem and to achieve the technical result to be provided by the invention.

A device for corking bottles having a neck with a rim and a cork, an end portion of the rim having protrusions providing the ability to raise the cork by rotating the same, the neck, rim and upper portion of the cork being rectangular and/or oval in horizontal cross-section;

- the protrusions at the rim end portion are arranged oppositely along the perimeter of its long sides;
- the protrusions are configured as arcs with a vertex at the rim middle portion;
- the neck and rim are, on the two wide sides thereof, are made in the form of flat common surfaces;
- the narrow sides of the rim are hook-shaped;
- the proposed arrangement with protrusions at the rim end may also be implemented at a circular rim;
- the neck, rim and upper portion of the cork are polygonal in the horizontal sections.

The neck is tapered towards the rim to join the neck and the rim at the narrow sides.

BRIEF DESCRIPTION OF THE DRAWINGS

While the drawings show the most preferred embodiment of the claimed device design, other variations are possible without altering the combination of claimed essential features of the present invention.

Figure 1:
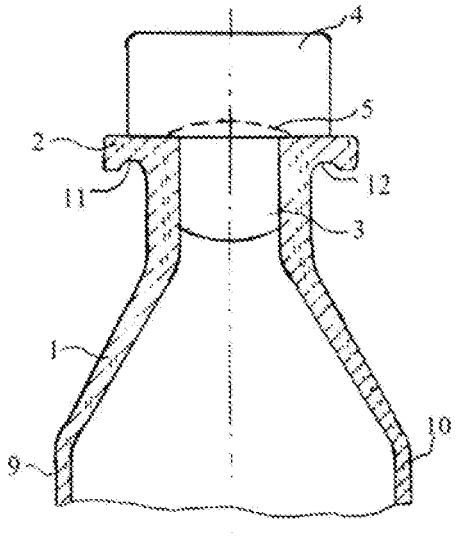
FIGS. 1-6 of the drawings show orthographic and perspective views of the claimed invention, including.

- a neck 1,
- a rim 2,
- a cork 3,
- a handle 4,
- protrusions 5 and 6,
- flat side members 7 and 8,
- convex ends 9 and 10, hooks 11 and 12.

While no bottle or joint between the bottle and the neck 1 is shown in the drawings, since they are not essential features determining the claimed essence of the invention, those skilled in the art will easily embody them in technical practice.

FIG. 1 is a longitudinal sectional view of a device for corking bottles (hereinafter 'the device') with a handle 4 being in the position of when the bottle is closed with the cork 3.

Figure 2:
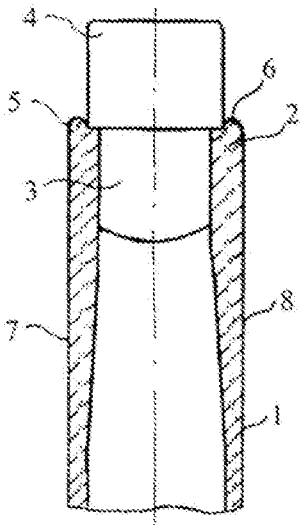

FIG. 2 is a cross-sectional view of the device with the handle 4 being in the position of when the bottle is closed with the cork 3.

Figure 3:
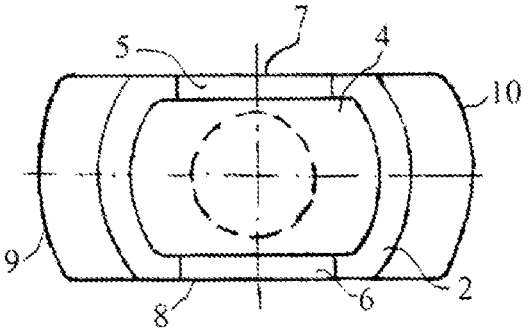

FIG. 3 is a top view of the device with the handle 4 being in the position of when the bottle is closed with the cork 3.

Figure 4:
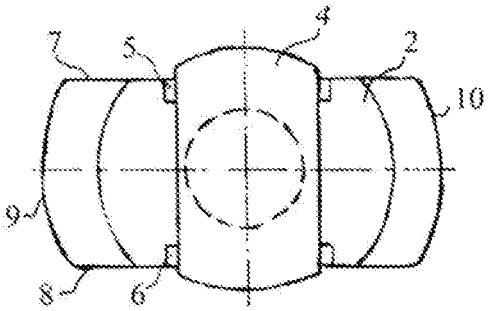

FIG. 4 is a top view of the device with the handle 4 in its lateral position (an early phase of the cork 3 removal from the rim 2).

Figure 5:
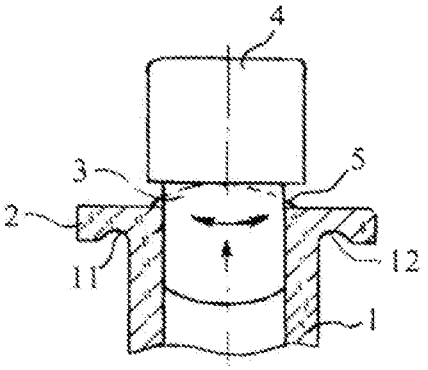

FIG. 5 is a longitudinal view of the device with the handle 4 being in the position of the early phase of the cork 3 removal from the rim 2.

Figure 6:
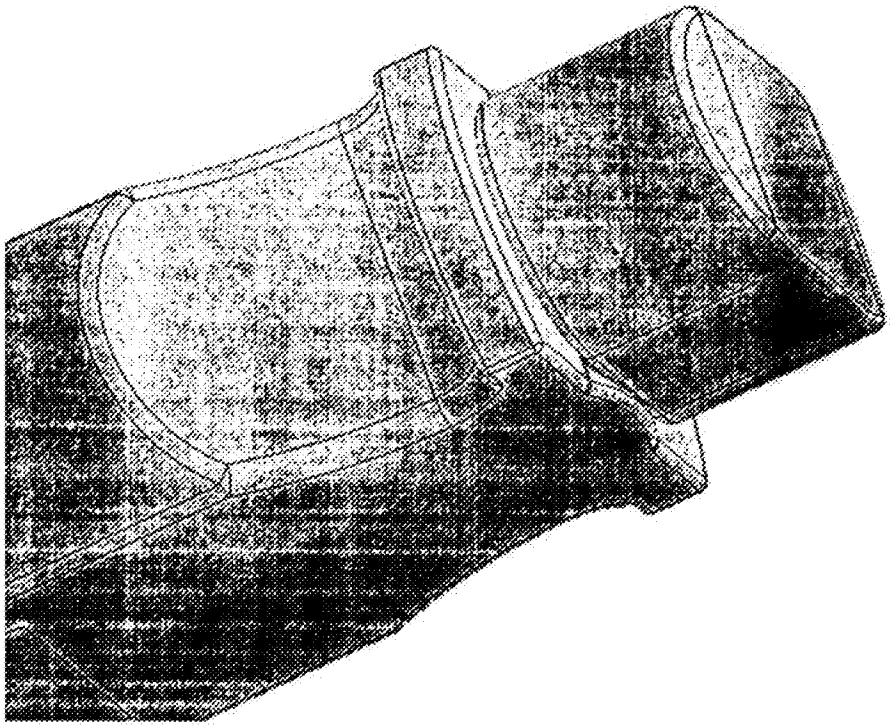

FIG. 6 is a perspective view of the device it the closed state.

DETAILED DESCRIPTION

As shown in the drawings, the lateral long sides 7 and 8 of the neck 1 and the rim 2 have common parallel surfaces.

The narrow sides of a portion of the neck adjacent to the rim are tapered towards the latter, the neck surface being convex at the sides 9 and 10. The tapering may have a variety of configurations.

The rim 2 portions at the narrow sides are configured as sideways hooks 11 and 12. The hooks may also be flat-shaped or shaped such as to mate with the suspenders.

The claimed invention (device) functions as follows.

In the initial state (when the bottled is closed), the handle 4 long side is positioned along the rim 2 within the protrusions 5 and 6.

In the early phase of the bottle opening, the bottle is gripped by one hand at its flat neck 1, while the handle 4 is being rotated by the other hand holding it at its long lateral sides in any direction until the handle 4 is brought in a transversal position relative to the rim 2.

At this time, the handle 4, at its lower surface, engages with the protrusions 5 and 6, reaching their vertexes when in the transversal position relative to the neck 1 and the rim 2; the cork 3, fixedly coupled to the handle 4, undergoing rotational and translational motion, is pulled out from the rim 2 of the neck 1.

By acting on the handle 4 at its long sides and holding the neck 1 at its flat side members 7 and 8, a considerable force may be produced facilitating initial breakaway of the cork 3 (in the direction of rotation thereof, while being pulled out of the rim).

Hereafter the handle 4 may be gripped not only at its lateral portions, but also at its lower portions to turn it in the horizontal plane and to rock it from side to side while pulling the cork 3 out, thus making the cork removal much easier.

Corking of the bottle for further temporary storage until next use is also facilitated.

The beverage is poured out along the rim 2 lateral surface, both along its wide and narrow sides, across the protrusions 5 and 6.

Currently, those skilled in the art will have no difficulty in manufacturing the components of the present invention in their entire combination, as with the state-of-the-art materials and technologies they may be serially produced at industrial scale.

The cork is manufactured from food-grade synthetic materials well known to those skilled in the art, and the handle may be manufactured from either synthetic materials, or glass.

No explanation of how to couple the cork to the handle is needed, since it is well known to those skilled in the art in both mechanical and technological aspects.

The claimed design is, therefore, novel and industrially applicable and provides the functionality to securely cork and uncork a bottle by initial breakaway of the cork, simultaneous rotation and pulling the cork out through the engagement between the handle's lower portion and the protrusions at the rim's upper portion, followed by simultaneous rotation, rocking from side to side and pulling the cork out, all these being possible by firmly gripping and holding the flat neck with one hand and the upper portion of the cork with the other hand by both right- and left-handed persons.

Furthermore, with the hooks at both sides of the rim's narrow portion, the bottle may be stored suspended in a vertical position.

The invention claimed is:

1. A combination of a bottle and a cork, wherein the bottle comprises:

a neck having two parallel lateral flat sides, two convex sides, a rim with outwardly extending hooks on the convex sides of the neck, a top end, the top end of the neck including a horizontal face and protrusions disposed on the horizontal face of the top end and arranged along opposite parallel lateral flat sides of the neck; and the cork comprises a handle, a part of the cork located above the top end of the neck, having two long sides, which are flat and parallel to each other, the two long sides of the handle being positioned between the protrusions, extending substantially parallel to long sides of the handle when the cork seals the bottle; and wherein when the cork is rotated, a lower side of the handle moves up and over vertexes of the protrusions so as to cause translational movement of the cork in an axial direction out of the neck.

2. The combination according to claim 1, wherein the protrusions are arc shaped.

* * * * *